US007355502B1

(12) United States Patent
Nguyen et al.

(10) Patent No.: US 7,355,502 B1
(45) Date of Patent: Apr. 8, 2008

(54) DIRECT RELAY CONNECTION TO A FUSIBLE LINK

(75) Inventors: Truong Quoc Nguyen, Canton, MI (US); Kenneth John Russel, Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 357 days.

(21) Appl. No.: 11/167,210

(22) Filed: Jun. 28, 2005

(51) Int. Cl.
*H01H 85/20* (2006.01)
*H01H 85/48* (2006.01)

(52) U.S. Cl. ..... 337/186; 337/187; 337/189; 361/626; 361/642

(58) Field of Classification Search ..... 337/186, 337/187, 189; 361/642, 626
See application file for complete search history.

(56) References Cited

U.S. PATENT DOCUMENTS

| | | | | |
|---|---|---|---|---|
| 3,060,293 | A | 10/1962 | Lapidus | |
| 3,634,812 | A * | 1/1972 | Genova | 439/250 |
| 4,227,761 | A * | 10/1980 | Cairns et al. | 439/357 |
| 4,372,638 | A * | 2/1983 | Sohler | 439/857 |
| 4,830,631 | A * | 5/1989 | Hsueh | 439/620.33 |
| 4,944,697 | A | 7/1990 | Dorman | |
| 4,972,295 | A * | 11/1990 | Suguro et al. | 361/706 |
| 5,125,855 | A | 6/1992 | Brooks | |
| 5,346,411 | A * | 9/1994 | Nikkinen | 439/620.26 |
| 5,476,396 | A | 12/1995 | De Castro | |
| 5,507,669 | A | 4/1996 | Jannett et al. | |
| 5,668,521 | A * | 9/1997 | Oh | 337/186 |
| 5,748,068 | A * | 5/1998 | Kiyota | 337/208 |
| 6,089,918 | A | 7/2000 | Arakelian et al. | |
| 6,320,486 | B1 | 11/2001 | Dietrich et al. | |
| 6,457,995 | B1 * | 10/2002 | Brooks | 439/620.29 |
| 6,520,780 | B2 * | 2/2003 | Chemin | 439/76.2 |
| 6,693,370 | B2 * | 2/2004 | Yamane et al. | 307/10.1 |
| 6,723,924 | B2 * | 4/2004 | Yuasa et al. | 174/68.2 |
| 6,796,808 | B2 * | 9/2004 | Hosoe et al. | 439/76.2 |
| 6,813,129 | B2 * | 11/2004 | Burdick | 361/104 |
| 6,905,346 | B2 * | 6/2005 | Momota et al. | 439/76.2 |
| 7,053,298 | B2 * | 5/2006 | Ikeda et al. | 174/50 |
| 2002/0126462 | A1 * | 9/2002 | Roussel et al. | 361/760 |
| 2004/0021547 | A1 | 2/2004 | Vicenza et al. | |
| 2005/0013095 | A1 * | 1/2005 | Oda | 361/601 |

* cited by examiner

*Primary Examiner*—Anatoly Vortman
(74) *Attorney, Agent, or Firm*—Daniel R. Edelbrock

(57) ABSTRACT

An assembly provides a direct electrical connection between a relay and a fusible link on the surface of a vehicle junction block. A fuse housing for the fusible link has a first, female terminal located near a top portion of the fuse housing. The first terminal is connected to a second terminal in the fuse housing by the fusible link. The junction block surface is configured such that the relay is mounted slightly above the fuse housing, whereby the top portion of the fuse housing forms a partial seat for the relay. An opening in the top portion of the fuse housing enables a male contact blade from the relay to be received by the first terminal. The second terminal in the fuse housing is connected to a power supply, or the relay is directly connected to the power supply and the second terminal electrically connects a different circuit directed into the junction block with the relay.

19 Claims, 7 Drawing Sheets

DIRECT RELAY CONNECTION TO A FUSIBLE LINK

BACKGROUND OF THE INVENTION

1. Field of the Invention

The invention relates in general to the interconnection of a fusible link and an electrical relay on a vehicle electrical junction block, and more specifically to an arrangement wherein the relay is electrically connected directly to the fusible link through a top of a housing containing the fusible link.

2. Discussion of Related Art

A typical power distribution box or electrical junction block as used in automotive vehicles eliminates multi-branch wiring by consolidating electrical components such as relays, fuses and connectors in a single location. A surface of the junction block has a plurality of slots forming footprints for receiving male contact blades of electromagnetic relays or other types of relays or switches, receptacles for receiving fuses or fuse cartridges, and other accommodations for electrical modules and connectors.

As illustrated in FIGS. 1 and 2, relays and fuses are usually electrically connected together by a stamped bus bar 20 with upstanding male end tabs 22 incorporated under the junction block surface. A rectangular fusible link housing 24 has a solid cover 26 and a slotted underside 28. Female terminals 30 are positioned within the housing 24 adjacent the underside 28 and connected by a fusible link 34. At one location on the junction block, a male tab 22 at one end of the bus bar 20 is received through the underside 28 of the housing 24 into engagement with one of the female terminals 30. The other female terminal of the fuse would receive, for example, a male contact of a power supply bus within the junction block. At another location in the junction block, a separate female-to-female terminal 36 is used to electrically connect a male contact blade 38 of a relay 40 with the other male end tab 22 of the bus bar 20. In other words, to complete the electrical interconnection of the fuse and relay, two extra parts, a female-to-female terminal 36 and a bus bar 20, are required. This creates additional electrical resistance in the circuitry and adds cost to the system.

As vehicle electrical systems become more complex and require more electrical components and extensive circuitry, there is design pressure to increase the size of the junction block. However, vehicle manufacturers often want the junction block to take up as small a space as possible within the vehicle. There have been attempts over the years to provide more efficient, interchangeable, compact packaging space on the junction block surface. For example, in U.S. Pat. No. 6,089,918, an adapter is used to enable fuses to plug into footprints originally meant for an electrical relay. This does not address the issue of more efficiently interconnecting a relay and fuse. It is also known in the art, for example from U.S. Pat. No. 6,320,486, to incorporate a fuse into a relay casing. This presents a bulkier relay and limits the ability of the fuse to be connected to other electrical circuitry.

SUMMARY OF THE INVENTION

Accordingly, it is an object of this invention to eliminate a female-to-female terminal and bus bar required for the contact interface between a relay and a fusible link within a junction block surface.

Another object of the invention is to reduce the packaging space typically needed on a junction block surface for physically separated fuses and relays.

A further object of the invention is to provide a fusible link housing that enables a relay to be directly electrically connected to the fusible link through a top portion of the housing.

In carrying out this invention in the illustrative embodiment thereof, a fusible link housing has two inner terminals connected by a fusible link. At least one of the inner terminals is a female terminal and is located adjacent to a top portion of the housing, while the other terminal is positioned near a slot through the underside of the housing. The top portion of the housing has a two-tiered cover with an aperture in the lower tier over the adjacent female terminal.

A junction block has a raised surface with sets of footprints, each set of footprints receiving all but one of male contact blades extending from a relay casing. A slightly lower surface immediately nearby or bordering the raised surface has receptacles for receiving fusible link housings as described.

During assembly, a fusible link housing is inserted into a receptacle on the junction block lower surface. The terminal positioned near the slot in the underside of the fusible link housing engages a circuit within the junction block, such as a power supply circuit. A relay is inserted into the adjacent footprint on the raised surface. The one relay contact blade not received in the footprint extends through the aperture in the cover of the fusible link housing and engages the female terminal. The lower tier of the cover provides a partial seat for the relay casing.

Since the relay and fuse positions essentially overlap, packaging space is reduced. The connection between the relay and fuse is direct and compact, with no required additional parts to take up extra space and add cost and resistance to the circuit. The design of the fusible link housing enables a top-loaded, stable connection with a standard relay.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 2:
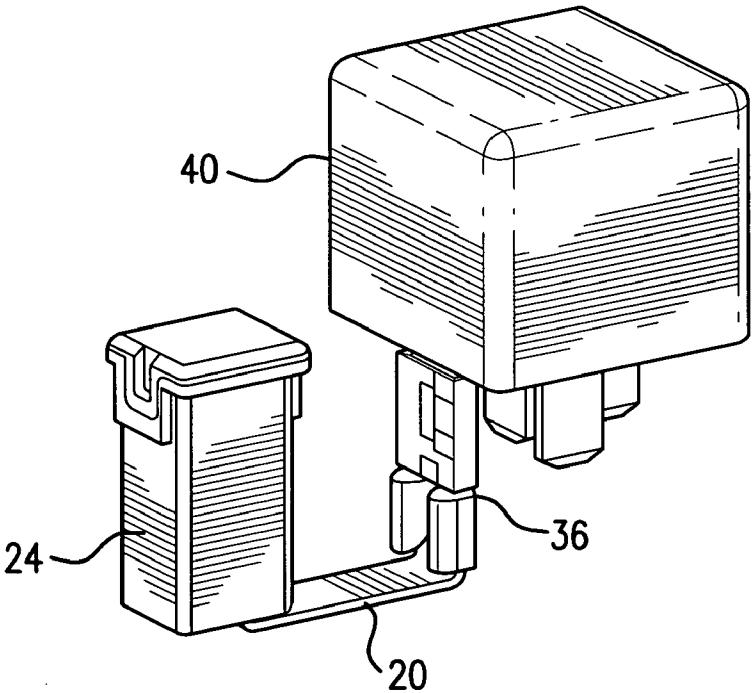
FIG. 2 PRIOR ART
FIG. 2 is perspective view of the assembled components of FIG. 1.
Figure 1:
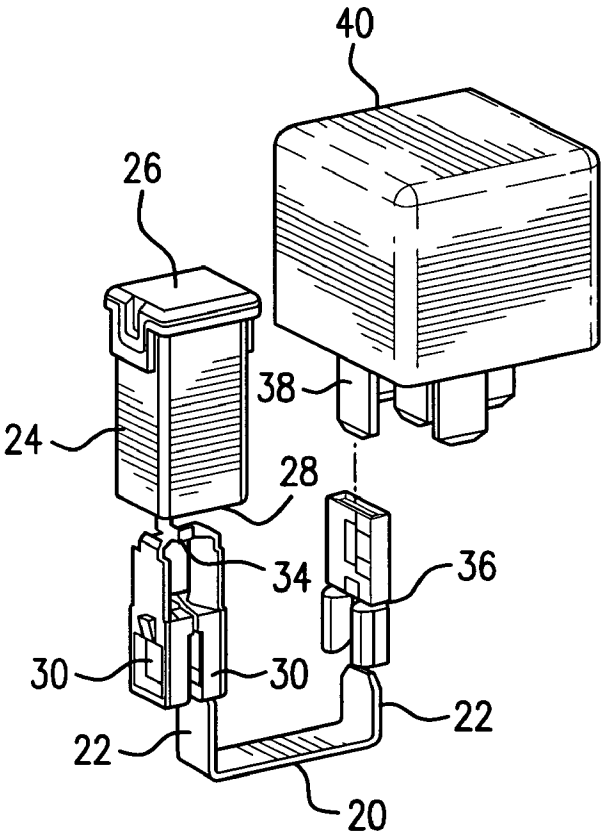
FIG. 1 PRIOR ART
FIG. 1 is an exploded perspective view of components used in a prior art fusible link and relay assembly.
Figure 4:
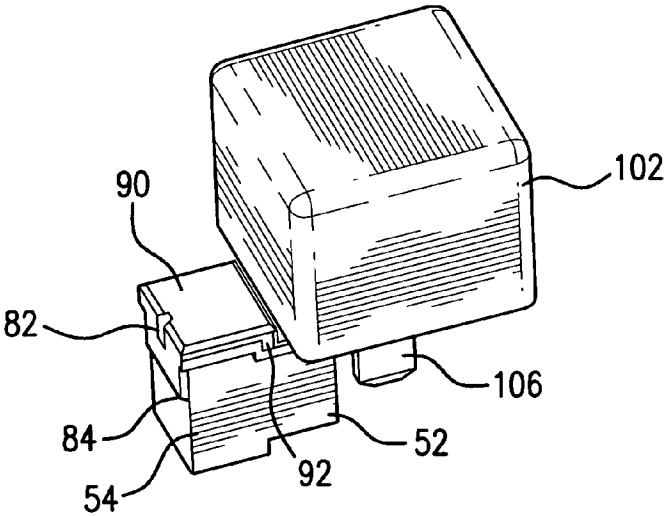
FIG. 4 is a perspective view of the assembled components of FIG. 3.
Figure 3:
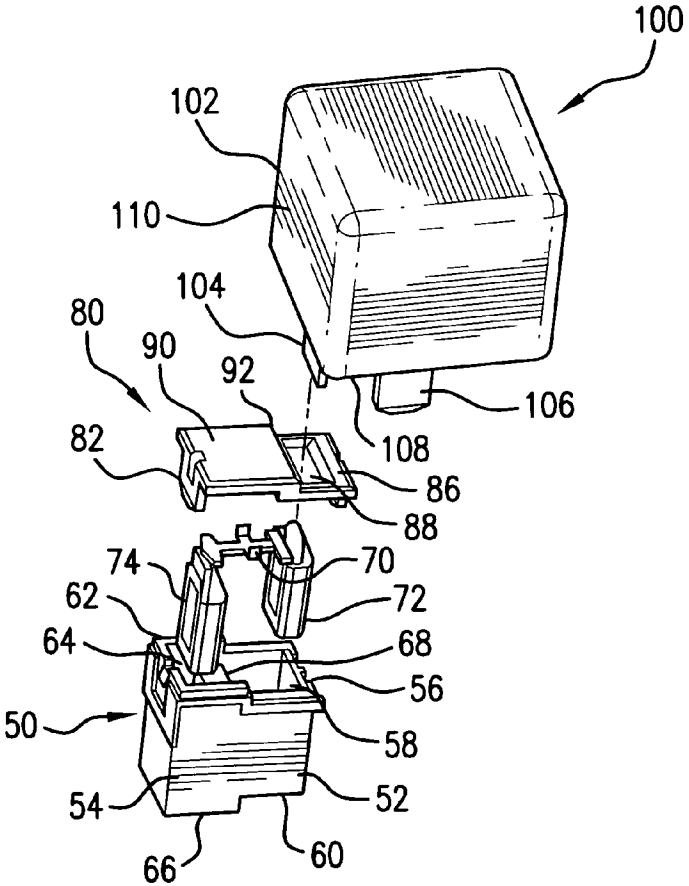
FIG. 3 is an exploded perspective view of the components used to electrically connect an electromagnetic relay and fusible link according to the present invention.

Referring now to FIGS. 3 and 4, a relay and fuse assembly according to the present invention comprises a substantially hollow fuse or fusible link housing 50 having a first section 52 integrally attached to a second section 54. Both sections are substantially rectangular. The housing may be molded or otherwise manufactured from an electrically non-conductive plastic such as Polyamide. The first section 52 has an upper side 56 with an opening 58 and an underside 60. The second section 54 includes an upper side 62 having an opening 64 and an underside 66. A slot (not shown) extends through the underside 66 of the second section 54. The second section 54 is wider and longer than the first section 52 such that the second section protrudes past the first section at each end of the housing 50. In other words, as oriented in the drawings, the upper side 62 of the second section 54 is in a higher plane than the upper side 56 of the first section 52, and the underside 66 of the second section is lower than the underside 60 of the first section. A narrow inner dividing wall 68 partially separates interiors of the first and second sections.

The fusible link housing 50 receives a fusible link 70 connected between a first terminal 72 and a second terminal 74. An example of the material used for the fusible element or link 70 would be tin, while the terminals could be stamped and formed from a copper alloy. The fusible link 70 is designed to separate or blow under conditions of excessive current. In the embodiment illustrated in FIG. 3, both terminals 72 and 74 are female terminals designed to receive flat male contacts or blades into reliable electrical engagement. The fusible link 70 extends at a right angle between each terminal, but the first terminal 72 is offset or closer to a plane of the fusible link relative to the second terminal 74. This means that, as oriented in the drawings, the first terminal 72 is positioned higher than the terminal 74. When received in the housing 50, the first terminal 72 would be located adjacent to or just under the opening 58 in the upper side 56 of the first section 52. The second terminal 74 would be located adjacent to or just above the slot in the underside 66 of the second section 54. The fusible link 70 would be positioned just above the inner dividing wall 68. In this manner, each terminal is positioned to receive a standard length male contact or blade.

A single-piece, thin, mostly transparent lid or cap 80, made from a plastic such as Polyethersulphone, is sized and configured to fit onto the upper sides of each section of the housing and is held in place by complimentary latch devices 82 and 84 on the cap and housing, respectively. The cap 80 covers the openings in the upper sides of the housings. To accomplish this, it has two levels or tiers. A first tier 86 is sized to fit over the upper side 56 of the first section 52 and has an aperture 88 enabling access to the first terminal 72. A second tier 90 is higher and has a larger surface area. The second tier 90 is sized to fit over the second section 54, closing the opening 64. The first and second tiers are joined by a short link portion 92 perpendicular to each tier.

FIGS. 3 and 4 also illustrate an electrical relay 100. The relay 100 may be a standard electromagnetic relay with a mechanical armature operated by current supplied to a ferromagnetic coil within a relay casing 102. Male blades or contacts 104 and 106 extend from the relay casing for incorporating the relay into an electrical circuit. Although only two relay contacts are shown in FIGS. 3 and 4, there are actually multiple contacts (typically five in automotive applications) arranged in a specific pattern for insertion into a footprint on a junction block surface. However, other types of relays or switches with various numbers of contacts may be used with the fusible link housing according to the present invention.

FIG. 4 illustrates the relay 100 assembled with the fusible link housing 50. A male contact 104 of the relay is inserted through the aperture 88 in the first tier 86 of the cap 80 into electrical engagement with the female terminal 72 in the first section 52 of the housing. A bottom portion 108 of the relay casing 102 seats against the tier 86 and upper side 56 of the first section 52 of the housing. The first tier is sized such that there is a tolerance or clearance between a side portion 110 of the relay casing 102 and the link portion 92 of the cap, minimizing the possibility of misaligned components obstructing the assembly process.

Figure 7:
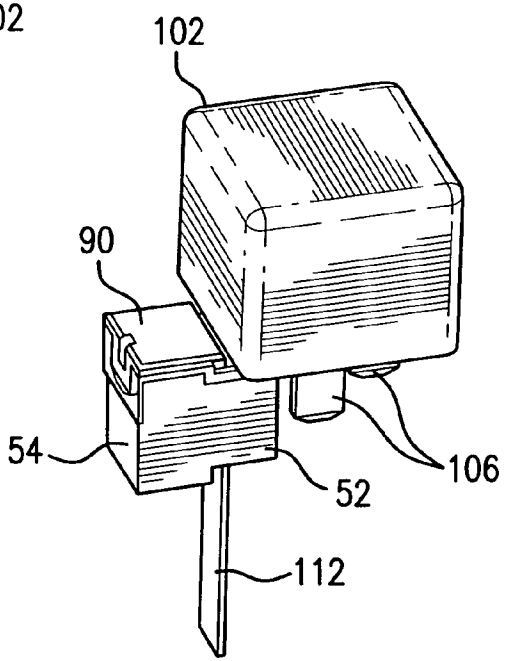
FIG. 7 is an assembled view of the FIG. 6 components.
Figure 6:
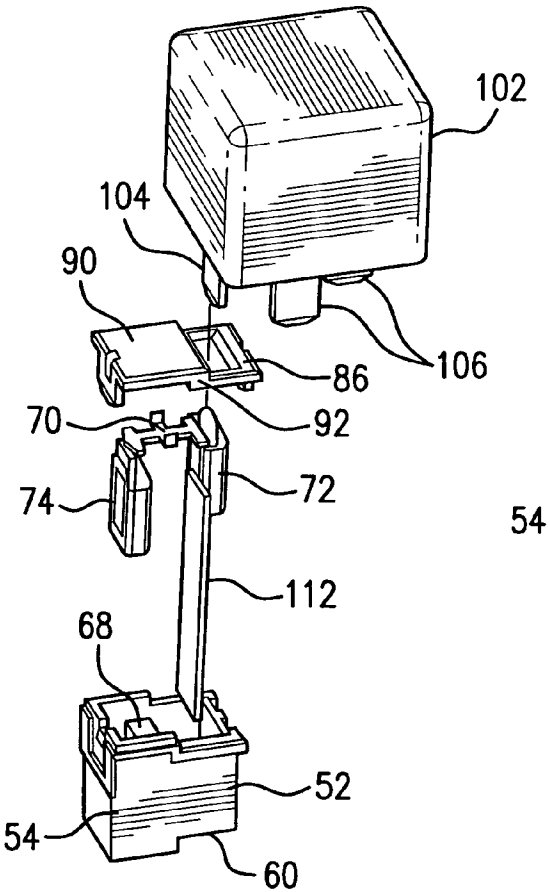
FIG. 6 is an exploded perspective view of the components of the second embodiment, including a modified terminal for receipt in the fusible link housing.
Figure 5:
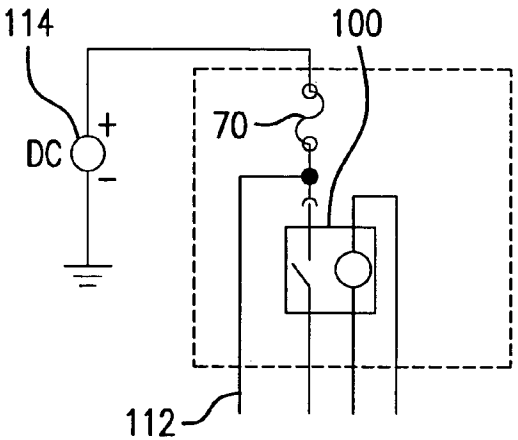
FIG. 5 is a schematic of an electrical circuit formed by a second embodiment of the fusible link and relay assembly according to the present invention.

The types of terminals 72 and 74 can be selected based on the intended electrical circuit. For the FIG. 3 embodiment, the second terminal 74 would receive a male contact or tab within the second section 54 from, for example, a power supply bus bar. The fusible link 70 would then protect the relay from overcurrent caused by a short to ground as a result of, for example, separated or damaged electrical wires. In another embodiment as depicted in FIGS. 5-7, the first female terminal is formed with a male extension 112 that projects from the underside 60 of the first section 52 of the housing 50 for connection to a downstream electrical device. The device could be, for examples, a cooling fan motor, lights, door lock solenoids or any other types of electrical loads. As depicted by the electrical circuit schematic of FIG. 5, when a source of power such as a battery 114 is used to provide power to the second terminal 74 of the fuse, the fusible link 70 would protect both the relay and the downstream device if an overcurrent occurs. It would also be within the scope of the invention to replace the first terminal 72 with a male terminal extending out of the upper side 56 of the first section 52 of the fusible link housing 50 if the relay is of a type having female contacts.

Figure 10:
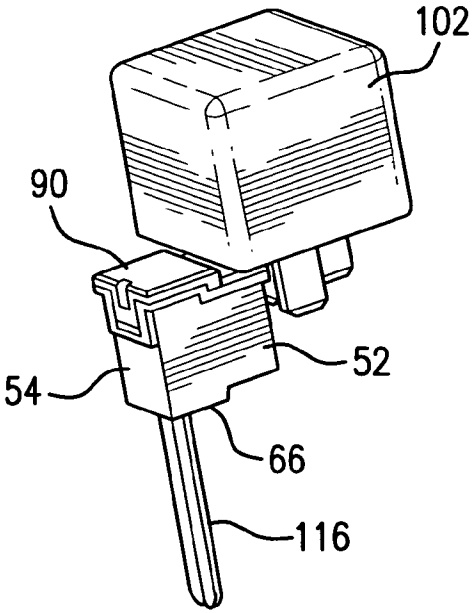
FIG. 10 is an assembled view of the FIG. 9 components.
Figure 9:
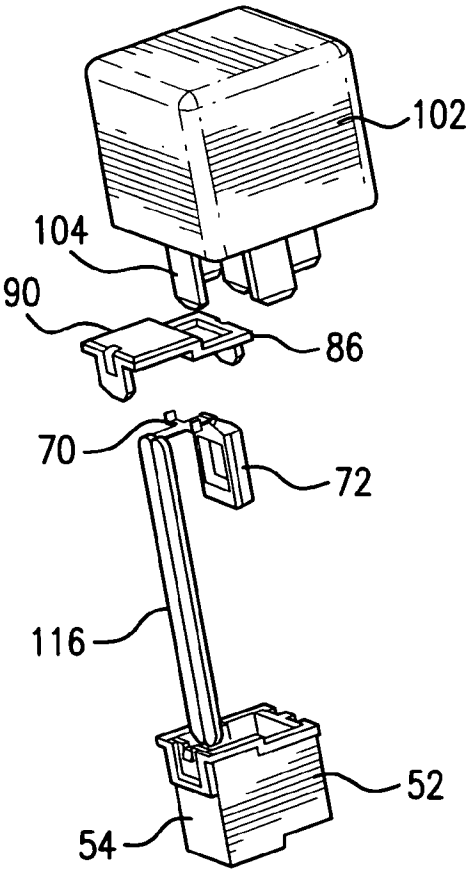
FIG. 9 is an exploded perspective view of the components making up the circuit of FIG. 8, with a modified terminal for receipt in the fusible link housing.
Figure 8:
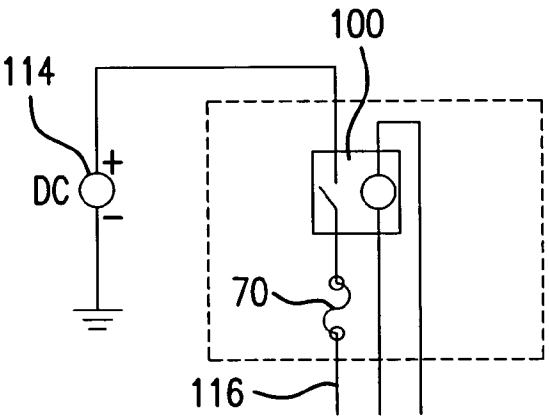
FIG. 8 is a schematic of an electrical circuit formed by another embodiment of the invention.

In the embodiment of FIGS. 8-10, the second terminal is a male terminal 116 that is not only adjacent the underside 66 of the second section 54 but extends through the underside 66 for connection to a female terminal in a circuit from a downstream device. As depicted by the electrical circuit schematic of FIG. 8, power from the battery 114 is provided directly to the relay 100, and fusible link 70 again protects the relay and downstream device. The difference between this and the embodiment of FIGS. 5-7 is that the male terminal 116 can be branched to serve multiple electrical loads, all protected directly by the fusible link.

Figure 11:
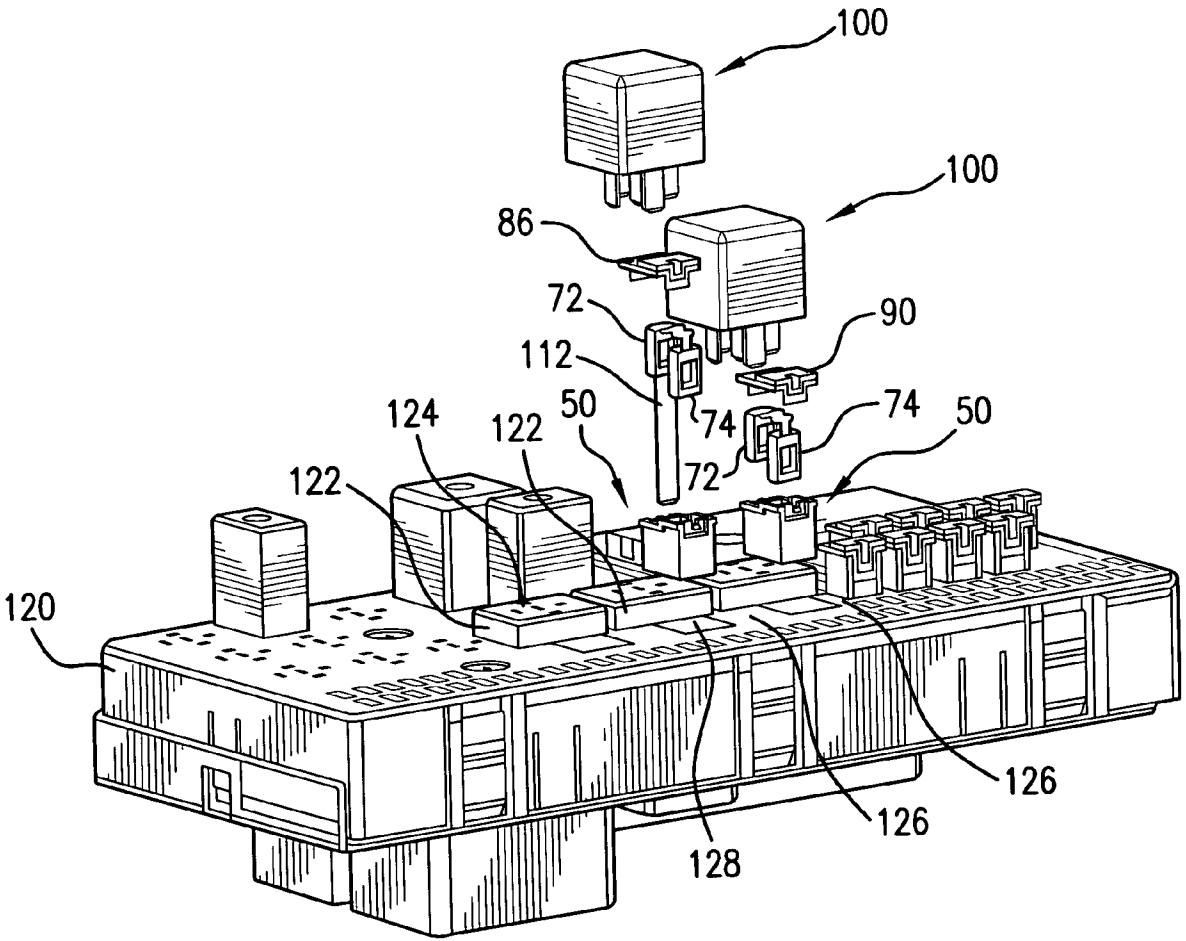
FIG. 11 is an exploded perspective view of a fusible link, relay and junction block arrangement according to the present invention.
Figure 12:
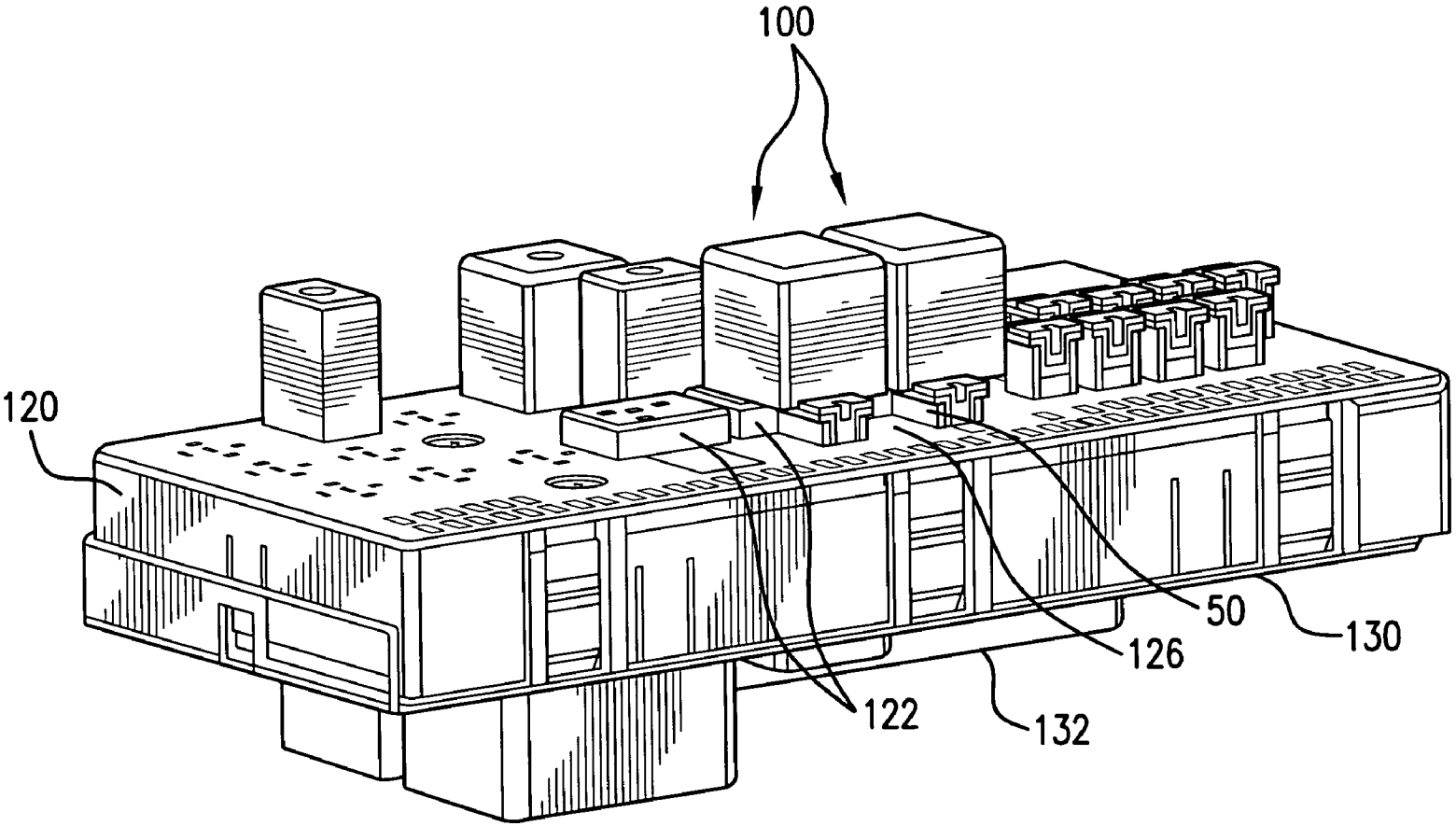
FIG. 12 is a perspective view of the completed assembly of FIG. 11.

FIGS. 11 and 12 illustrate how the electrical interconnection of the fusible link housing 50 and relay 100 according to the present invention is advantageously used on a vehicle junction block 120. The vehicle junction block includes at least one first, higher or raised surface 122 with multiple sets of footprints 124 for receiving relays 100 into connection with the circuits served by the junction block. The illustrated footprint is one that is commonly employed in automotive applications. The footprints 124 are configured to receive all the male contact blades of each relay except for the one needed for connection to the fusible link 70. At least one second, lower surface 126 immediately adjacent the first surface 122 contains multiple receptacles 128 for receiving the fusible link housings 50.

The depth of the receptacles 128, the height of the raised surface 122, and the relative positions of the footprints are all disposed in a predetermined arrangement such that when a fusible link housing 50 is inserted into a receptacle 128 and a relay 100 is then inserted into an associated footprint 124, the relay is positioned above the first section 52 of the fusible link housing. The upper side 56 of the first section 52 is substantially level with the first surface 122 of the junction block 120. Plugging the relay into the footprint 124 in the proper manner inserts the relay contact 104 through the aperture 88 in the cap 80 into the first section 52 and into electrical engagement with the first terminal 72. The upper side 56 of the first section 52 and the first tier 86 of the cap 80 provide a partial seat for the bottom portion 108 of the relay casing 102 overhanging the second surface 126 of the junction block 120, ensuring some stability to the relay and reducing vibration. Again there is a clearance or tolerance between the relay casing and the link portion 92 of the cap 80 to prevent obstruction of the connection.

Figure 13:
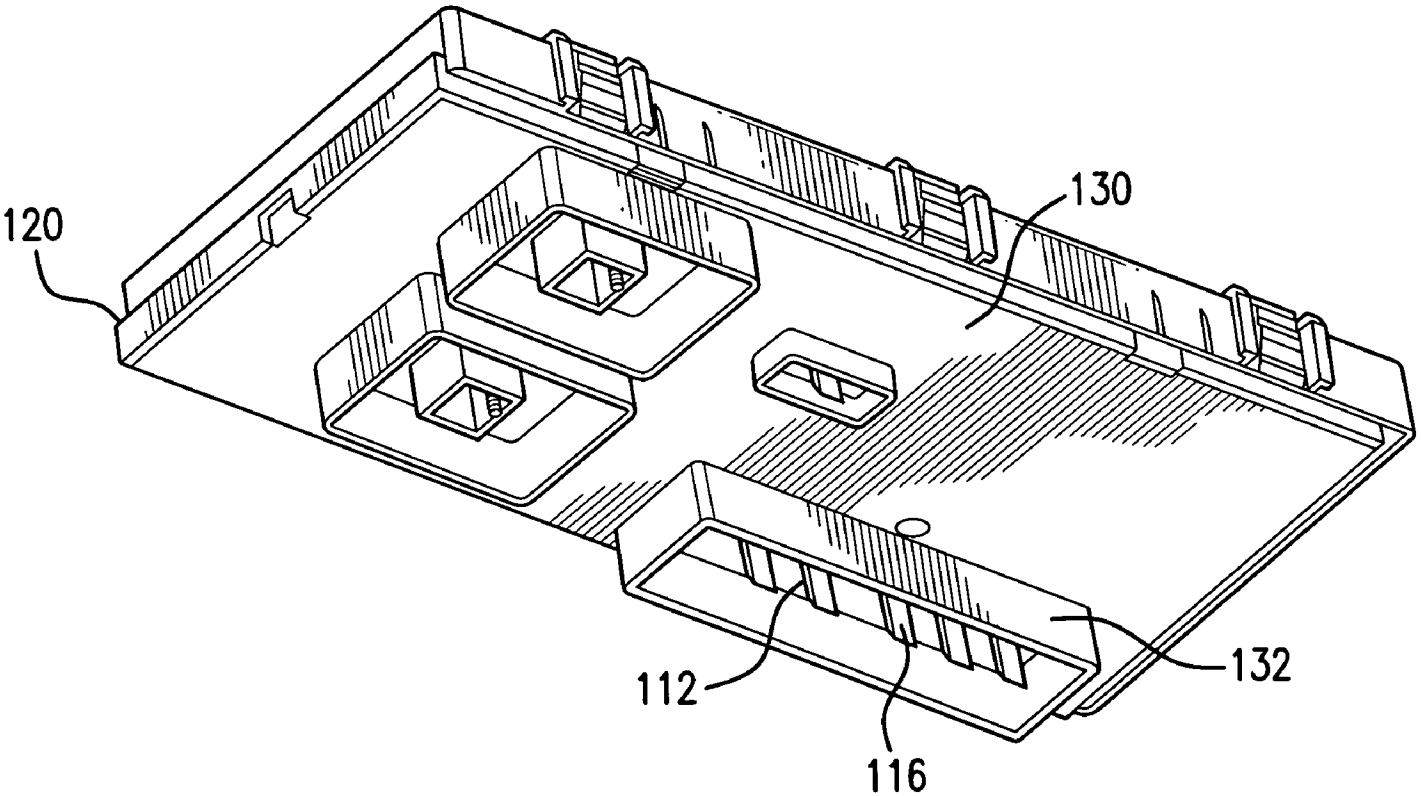
FIG. 13 is an underside view of the junction block.

FIG. 13 illustrates a bottom surface 130 of the junction block 120. As described, there are embodiments wherein male terminals 112 or 116 extend from an underside 60 or 66, respectively, of the fusible link housing 50. The terminals would extend through the junction block into a connector port 132 arranged on the bottom surface 130. A connector with terminals from the downstream devices would engage the port 132 and the terminals would electrically engage any male terminals 112, 116 extending through the junction block 120 from the fusible link housing 50.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical assembly comprising in combination:

an electrical relay having a casing with projecting male contacts;

a fuse housing having an inner fusible link connecting a first, inner terminal and a second terminal, the first terminal being located adjacent to a top portion of the housing and being accessible through an opening in the top portion; and a junction block having a first surface with slots for receiving all but one of the male contacts of the relay for internal electrical connection with the junction block, and a second surface close to the first surface, the second surface having a receptacle for receiving the fuse housing, the second surface and receptacle being arranged to position the top portion of the fuse housing such that the male contact of the relay not received in one of the junction block slots extends through the opening in the top portion of the fuse housing and electrically connects with the first terminal.

2. The assembly of claim 1 wherein the second terminal is a female terminal.

3. The assembly of claim 1 further comprising a male terminal extending from the first terminal out of the fuse housing into the junction block.

4. The assembly of claim 3 wherein the male terminal is integrally formed with the first terminal.

5. The assembly of claim 3 wherein a length of the male terminal is such that the male terminal projects from an underside of the junction block.

6. The assembly of claim 1 wherein the second terminal is a male terminal that extends out of the fuse housing into the junction block.

7. The assembly of claim 6 wherein a length of the male terminal is such that the male terminal projects from an underside of the junction block.

8. The assembly of claim 1 wherein the top portion of the fuse housing is configured in two different planes.

9. The assembly of claim 8 wherein a lower of the two planes is substantially level with the first surface of the junction block and provides a partial seat for the relay casing.

10. The assembly of claim 1 wherein the top portion of the housing includes a releasable cover having an aperture aligned with the opening.

11. The assembly of claim 1 wherein the first surface of the junction block is raised relative to the second surface.

12. The assembly of claim 1 wherein there are multiple slots and receptacles in the junction block surfaces for receiving multiple electrical relays and fuse housings interconnected through the top portions of the fuse housings.

13. A fuse housing for enabling direct connection of a fusible link and electrical relay on a junction block surface, the fuse housing comprising:

a first section having an upper side and an inner terminal;

a second section joined to the first section and having an upper side, the second section having an inner terminal connected to the inner terminal of the first section by the fusible link, the terminals being arranged at different elevations within the housing such that the inner terminal of the first section is located adjacent to an opening in the upper side of the first section and the inner terminal of the second section is located adjacent to a opening in a lower side of the second section; and a cap having a first portion for covering the upper side of the first section, the first portion of the cap having an aperture for providing access to the inner terminal of the first section by a contact of the relay, the cap having a second portion offset from the first portion for covering the upper side of the second section.

14. The fuse housing of claim 13 wherein the first portion of the cap is configured to provide a partial seat for the relay when a relay contact is mated with the inner terminal of the first section.

15. The fuse housing of claim 13 wherein the upper side of the first section is lower than the upper side of the second section, the cap being configured in two tiers to fit over both upper sides, a lower tier of the cap providing a partial seat for the relay.

16. The fuse housing of claim 13 wherein the inner terminals are female terminals.

17. The fuse housing of claim 16 further comprising a male terminal connected to the female inner terminal of the first section and extending out of the fuse housing.

18. The fuse housing of claim 13 wherein the inner terminal of the second section is a male terminal, and part of the male terminal extends out of the fuse housing.

19. A method for electrically interconnecting a relay and fusible link on a junction block surface comprising the steps of:

inserting a fusible link housing into a receptacle on the surface, the fusible link housing providing access to the fusible link through a top portion of the housing; and mounting a relay on the junction block surface over part of the fusible link housing such that a contact of the relay extends through the top portion of the housing into electrical contact with the fusible link.

* * * * *